US009228738B2

(12) United States Patent
Tilmont et al.

(10) Patent No.: US 9,228,738 B2
(45) Date of Patent: Jan. 5, 2016

(54) DOWNHOLE COMBUSTOR

(71) Applicant: Orbital ATK, Inc., Dulles, VA (US)

(72) Inventors: Daniel Tilmont, Rocky Point, NY (US); Troy Custodio, Centereach, NY (US)

(73) Assignee: Orbital ATK, Inc., Dulles, VA (US)

( * ) Notice: Subject to any disclaimer, the term of this patent is extended or adjusted under 35 U.S.C. 154(b) by 383 days.

(21) Appl. No.: 13/745,196

(22) Filed: Jan. 18, 2013

(65) Prior Publication Data

US 2013/0341015 A1 Dec. 26, 2013

Related U.S. Application Data

(60) Provisional application No. 61/664,015, filed on Jun. 25, 2012.

(51) Int. Cl.

| | |
|---|---|
| ***E21B 36/02*** | (2006.01) |
| ***F22B 1/18*** | (2006.01) |
| ***E21B 43/243*** | (2006.01) |
| ***E21B 43/263*** | (2006.01) |
| ***F23D 14/02*** | (2006.01) |
| ***F23D 14/70*** | (2006.01) |
| ***F23Q 7/00*** | (2006.01) |
| ***E21B 43/12*** | (2006.01) |

(Continued)

(52) U.S. Cl.

CPC ..... *F22B 1/1853* (2013.01); *E21B 36/02* (2013.01); *E21B 43/122* (2013.01); *E21B 43/24* (2013.01); *E21B 43/243* (2013.01); *E21B 43/26* (2013.01); *E21B 43/263* (2013.01); *F22B 27/02* (2013.01); *F22B 27/12* (2013.01); *F23D 14/02* (2013.01); *F23D 14/70* (2013.01); *F23Q 7/00* (2013.01); *F23R 3/343* (2013.01); *Y10T 137/0329* (2015.04)

(58) Field of Classification Search

CPC combination set(s) only.
See application file for complete search history.

(56) References Cited

U.S. PATENT DOCUMENTS 1,663,228 A * 3/1928 Zublin ..... 285/417
2,707,029 A 4/1955 Van Hartesveldt (Continued)

FOREIGN PATENT DOCUMENTS

EP 2 199 538 A2 6/2010
GB 2 287 312 A 9/1995

(Continued)

OTHER PUBLICATIONS

Blogspot.com, Centrifugal Pump/Deep Well Pump/Sump Pump [online], Aug. 1, 2008, [retrieved on Nov. 26, 2013]. Retrieved from the internet <http://pump-detail.blogspot.com/2008_08_01_archive.html>, 14 pages.

(Continued)

*Primary Examiner* — David Andrews
*Assistant Examiner* — Kyle Armstrong
(74) *Attorney, Agent, or Firm* — TraskBritt

(57) ABSTRACT

A downhole combustor system for a production well is provided. The downhole combustor includes a housing, a combustor and an exhaust port. The housing is configured and arranged to be positioned down a production well. The housing further forms a combustion chamber. The combustor is received within the housing. The combustor is further configured and arranged to combust fuel in the combustion chamber. The exhaust port is positioned to deliver exhaust fumes from the combustion chamber into a flow of oil out of the production well.

15 Claims, 10 Drawing Sheets

(51) Int. Cl.

| | |
|---|---|
| ***E21B 43/24*** | (2006.01) |
| ***E21B 43/26*** | (2006.01) |
| ***F23R 3/34*** | (2006.01) |
| ***F22B 27/02*** | (2006.01) |
| ***F22B 27/12*** | (2006.01) |

(56) References Cited

U.S. PATENT DOCUMENTS

| | | | |
|---|---|---|---|
| 2,803,305 | A | 8/1957 | Behning et al. |
| 3,223,539 | A | 12/1965 | Hyde et al. |
| 3,284,137 | A | 11/1966 | Wolber |
| 3,456,721 | A | 7/1969 | Smith |
| 3,482,630 | A | 12/1969 | Earlougher, Jr. |
| 3,522,995 | A | 8/1970 | Erickson |
| 3,674,093 | A | 7/1972 | Reese |
| 4,205,725 | A | 6/1980 | Howard et al. |
| 4,237,973 | A | 12/1980 | Todd |
| 4,243,098 | A | 1/1981 | Meeks et al. |
| 4,336,839 | A | 6/1982 | Wagner et al. |
| 4,377,205 | A | 3/1983 | Retallick |
| 4,380,265 | A | 4/1983 | Mohaupt |
| 4,380,267 | A | 4/1983 | Fox |
| 4,385,661 | A | 5/1983 | Fox |
| 4,390,062 | A | 6/1983 | Fox |
| 4,397,356 | A | 8/1983 | Retallick |
| 4,411,618 | A | 10/1983 | Donaldson et al. |
| 4,421,163 | A | 12/1983 | Tuttle |
| 4,431,069 | A | 2/1984 | Dickinson, III et al. |
| 4,442,898 | A | 4/1984 | Wyatt |
| 4,458,756 | A | 7/1984 | Clark |
| 4,463,803 | A | 8/1984 | Wyatt |
| 4,471,839 | A | 9/1984 | Snavely et al. |
| 4,498,531 | A | 2/1985 | Vrolyk |
| 4,522,263 | A | 6/1985 | Hopkins et al. |
| 4,558,743 | A | 12/1985 | Ryan et al. |
| 4,648,835 | A | 3/1987 | Eisenhawer et al. |
| 4,682,471 | A | 7/1987 | Wagner |
| 4,699,213 | A | 10/1987 | Fleming |
| 4,718,489 | A | 1/1988 | Hallam et al. |
| 4,783,585 | A | 11/1988 | Meshekow |
| 4,805,698 | A | 2/1989 | Baugh et al. |
| 4,834,174 | A | 5/1989 | Vandevier |
| 4,895,206 | A | 1/1990 | Price |
| 5,052,482 | A | 10/1991 | Gondouin |
| 5,211,230 | A | 5/1993 | Ostapovich et al. |
| 5,339,897 | A | 8/1994 | Leaute |
| 5,525,044 | A | 6/1996 | Chen |
| 5,623,576 | A | 4/1997 | Deans |
| 5,623,819 | A | 4/1997 | Bowker et al. |
| 5,775,426 | A | 7/1998 | Snider et al. |
| 6,959,760 | B1 | 11/2005 | Braithwaite et al. |
| 7,493,952 | B2 | 2/2009 | Ayasse |
| 7,497,253 | B2 | 3/2009 | Retallick et al. |
| 7,628,204 | B2 | 12/2009 | Iqbal et al. |
| 7,640,987 | B2 | 1/2010 | Kalman et al. |
| 7,665,525 | B2 | 2/2010 | Pfefferle |
| 7,712,528 | B2 | 5/2010 | Langdon et al. |
| 7,784,533 | B1 | 8/2010 | Hill |
| 7,946,342 | B1 | 5/2011 | Robertson |
| 8,091,625 | B2 | 1/2012 | Ware et al. |
| 2007/0284107 | A1 | 12/2007 | Crichlow |
| 2008/0017381 | A1 | 1/2008 | Baiton |
| 2008/0087427 | A1 | 4/2008 | Kaminsky et al. |
| 2009/0260811 | A1 | 10/2009 | Cui et al. |
| 2009/0288827 | A1 | 11/2009 | Coskuner |
| 2010/0181069 | A1 | 7/2010 | Schneider et al. |
| 2010/0224370 | A1 | 9/2010 | Donnelly et al. |
| 2011/0000666 | A1 | 1/2011 | Couto |
| 2011/0120710 | A1 | 5/2011 | Dong et al. |
| 2011/0127036 | A1 | 6/2011 | Tilmont et al. |
| 2011/0227349 | A1 | 9/2011 | Huber et al. |
| 2011/0297374 | A1 | 12/2011 | Kuhlman et al. |
| 2013/0161007 | A1 | 6/2013 | Wolfe et al. |

FOREIGN PATENT DOCUMENTS

| | | | |
|---|---|---|---|
| WO | WO 2006/063200 | A2 | 6/2006 |
| WO | WO 2011/103190 | A1 | 8/2011 |

OTHER PUBLICATIONS

International Search Report for Application No. PCT/US2013/047268 mailed Oct. 7, 2013.

International Written Opinion for Application No. PCT/US2013/047268 mailed Oct. 7, 2013, 6 pages.

International Preliminary Report on Patentability for Application No. PCT/US2013/047268 dated Dec. 31, 2014, 7 pages.

* cited by examiner

DOWNHOLE COMBUSTOR

CROSS-REFERENCE TO RELATED APPLICATION

This application claims priority to U.S. Provisional Patent Application No. 61/664,015, titled "Apparatuses and Methods Implementing a Downhole Combustor," filed on Jun. 25, 2012, which is incorporated in its entirety herein by reference.

BACKGROUND

Artificial lift techniques are used to increase the flow rate of oil out of a production well. One commercially available type of an artificial lift is a gas lift. With a gas lift, compressed gas is injected into a well to increase the flow rate of produced fluid by decreasing head losses associated with weight of the column of fluids being produced. In particular, the injected gas reduces pressure on a bottom of the well by decreasing bulk density of the fluid in the well. The decreased density allows the fluid to flow more easily out of the well. Gas lifts, however, do not work in all situations. For example, gas lifts do not work well with a reserve of high viscosity oil (heavy oil). Typically, thermal methods are used to recover heavy oil from a reservoir. In a typical thermal method, steam generated at the surface is pumped down a drive side well into a reservoir. As a result of the heat exchange between the steam pumped into the well and the downhole fluids, the viscosity of the oil is reduced by an order of magnitude that allows it to be pumped out of a separate producing bore. A gas lift would not be used with a thermal system because the relatively cool temperature of the gas would counter the benefits of the heat exchange between the steam and the heavy oil therein increasing the viscosity of the oil and negating the desired effect of the thermal system.

Other examples where gas lifts are not suitable for use are production wells where there are high levels of paraffins or asphaltenes. The pressure drop associated with delivering the gas lift, changes the thermodynamic state and makes injection gases colder than the production fluid. The mixing of the cold gases with the production fluids acts to deposit these constituents on the walls of production piping. These deposits can reduce or stop the production of oil.

For the reasons stated above and for other reasons stated below, which will become apparent to those skilled in the art upon reading and understanding the present specification, there is a need in the art for an effective and efficient apparatus and method of extracting oil from a reservoir.

BRIEF SUMMARY

The above-mentioned problems of current systems are addressed by embodiments of the present invention and will be understood by reading and studying the following specification.

The following summary is made by way of example and not by way of limitation. It is merely provided to aid the reader in understanding some of the aspects of the invention.

In one embodiment, a downhole combustor system is provided. The downhole combustor system includes a housing, a combustor and an exhaust port. The housing is configured and arranged to be positioned down a production well. The housing further forms a combustion chamber. A combustor is received within the housing. The combustor is configured and arranged to combust fuel in the combustion chamber. The exhaust port is positioned to deliver exhaust fumes from the combustion chamber into a flow of oil out of the production well.

In another embodiment, another downhole combustor system for a production well is provided. The downhole combustor system includes a housing, at least one delivery connector, a combustor and a combustion chamber exhaust port. The housing has an oil and exhaust gas mixture chamber and a combustor chamber. The housing has at least one oil input port that passes through an outer shell of the housing allowing passage into the oil and exhaust gas mixture chamber for oil from a production well. The housing further has at least one oil and exhaust gas output port that passes through the outer shell of the housing and is spaced a select distance from the at least one oil input port. The at least one oil and exhaust gas output port is configured and arranged to pass oil and exhaust gas out of the housing. The housing further has at least one delivery passage that passes within the outer shell of the housing. The at least one delivery connector is coupled to the housing. Each delivery connector is in fluid communication with at least one associated delivery passage. The combustor is configured and arranged to combust fuel in the combustion chamber. The combustor is further configured and arranged to receive fuel and air passed in the at least one delivery passage. The combustion chamber exhaust port is positioned to pass exhaust gases from the combustion chamber to the oil and exhaust gas mixture chamber.

In still another embodiment, a method of extracting oil from an oil reservoir is provided. The method includes: positioning a downhole combustor in a production wellbore to the oil reservoir; delivering fuel to the combustor through passages in a housing containing the combustor; initiating an ignition system of the combustor; combusting the fuel in a combustion chamber in the housing; and venting exhaust gases into the wellbore.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout the figures and the specification.

DETAILED DESCRIPTION

In the following detailed description, reference is made to the accompanying drawings, which form a part hereof and in which is shown by way of illustration, specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments of the present invention provide a downhole combustor system for use in a production well. In some embodiments, the downhole combustor system is part of a thermal gas lift 100. Embodiments of a combustion thermal gas lift provide advantages over traditional thermal methods that direct steam down a drive side well (dry well). For example, since very little water is generated in the downhole combustor system (i.e., merely in the form of water vapor in the combustion process), limited clean up of water is required. Moreover, embodiments are relatively portable, which allows for ease of use in remote locations such as offshore reservoirs. The downhole combustor system has many other applications that go beyond just heating oil, such as, but not limited to, gasification, electricity generation and reforming as discussed briefly below.

Figure 1:
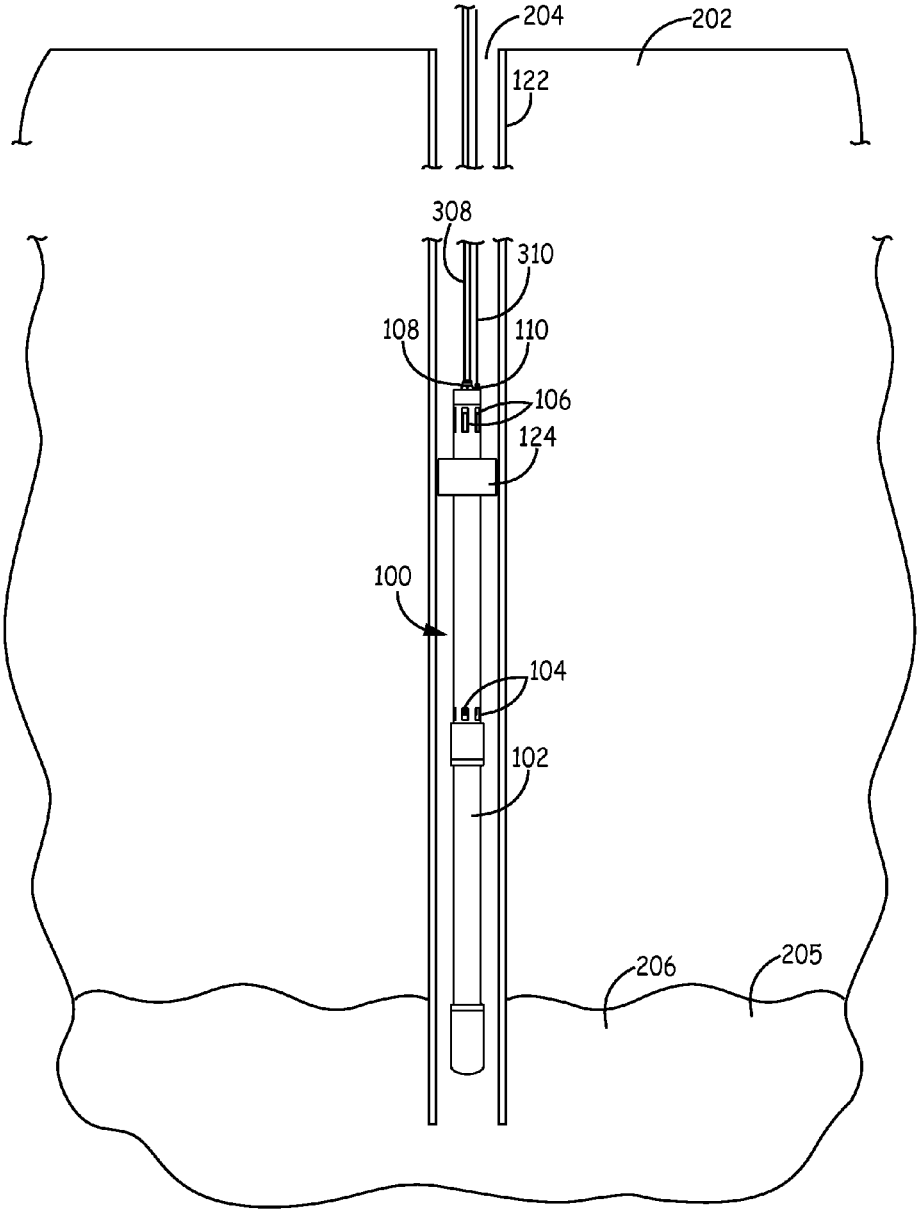
FIG. 1 is a side view of a thermal gas lift including a downhole combustor of one embodiment of the present invention.

Referring to FIG. 1, a thermal gas lift 100 of an embodiment with a downhole combustor system is illustrated. FIG. 1 illustrates, a casing 122 positioned in a wellbore 204 drilled through the ground 202 to an oil reserve 205 containing oil 206. Down the wellbore in the casing 122 is positioned a thermal gas lift 100. A packing seal 124 is positioned between a housing 102 of the thermal gas lift 100 and the casing 122 to form a seal. The packing seal 124 prevents oil 206 from passing up around the outside of the housing 102 of the thermal gas lift 100. The housing 102 of the thermal gas lift 100 of FIG. 1 is shown having a plurality of oil intake ports 104. Oil 206 from the oil reservoir 205 enters the oil intake ports 104 in the housing 102. The oil 206 is then heated up in the housing 102, as discussed below, and is then passed out of oil and exhaust gas outlet ports 106 in the housing 102. As illustrated, the oil and exhaust gas outlet ports 106 (or oil and gas outlet ports 106) of the housing 102 are positioned above packing seal 124. The oil 206 above the packing seal 124 can then be pumped out using traditional pumping methods known in the art. Since the viscosity of the oil 206 will have been reduced by the thermal gas lift 100, the traditional pumping methods will be effective even for high viscosity oil (heavy oil) production. Also illustrated in FIG. 1, is a first delivery intake connector 108 and a second delivery intake connector 110. The first delivery intake connector 108 is designed to couple a first delivery conduit 308 to the thermal gas lift 100 and the second delivery intake connector 110 is designed to couple a second delivery conduit 310 to the thermal gas lift 100. In an embodiment, first and second delivery conduits 308, 310 deliver select gases, fluids, and the like, to the thermal gas lift 100 for combustion such as, but not limited to, air and methane. Although, only two delivery intake connectors 108 and 110 are shown, it will be understood that more or even less connectors can be used depending on what is needed for the function of the thermal gas lift 100. Moreover, in one embodiment, a delivery intake connector 108 or 110 provides a connection for electricity to power an igniter system for the combustor 500, as discussed below.

Figure 2:
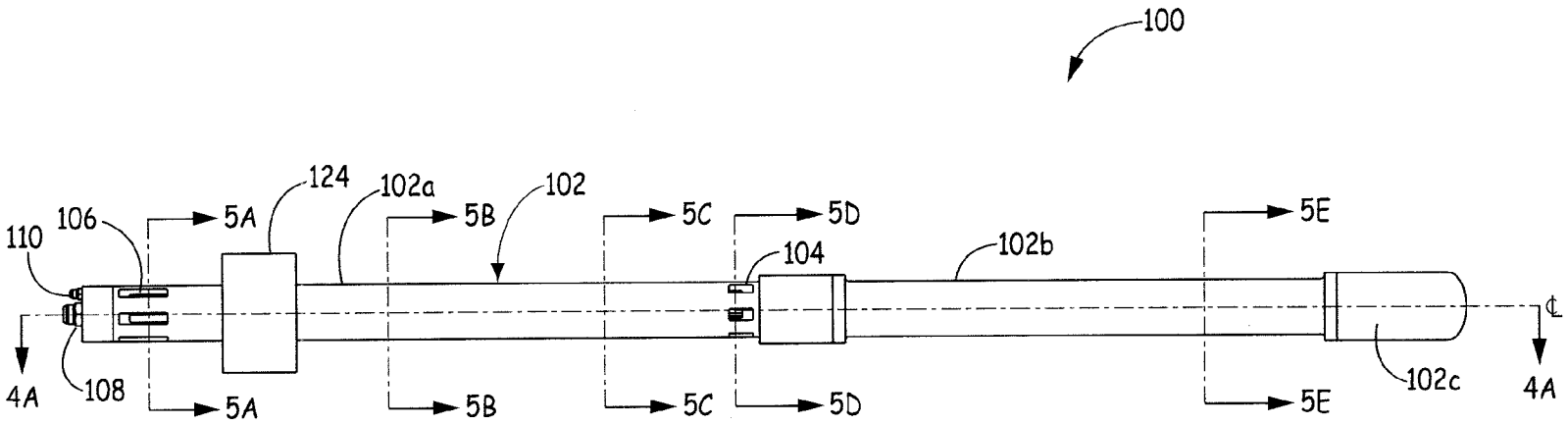
FIG. 2 is a side view of the thermal gas lift of FIG. 1.
Figure 3:
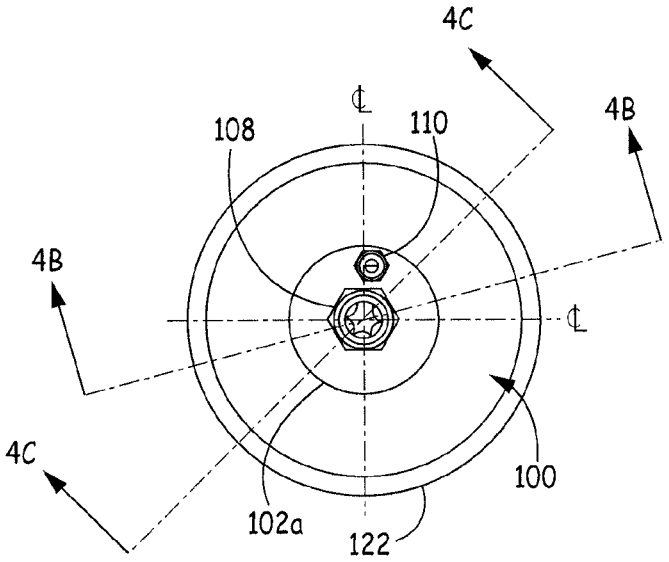
FIG. 3 is a top view of the thermal gas lift of FIG. 1.
Figure 4A:
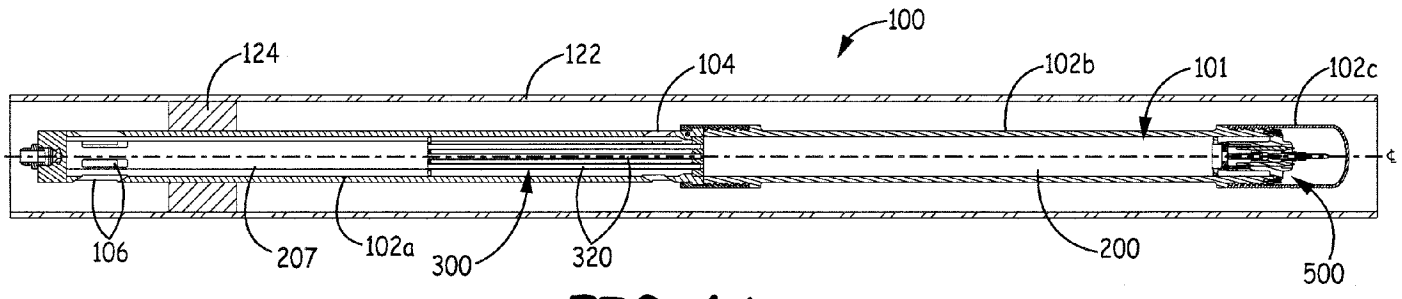
FIG. 4A is a cross-sectional side view of the thermal gas lift along section line 4A-4A of FIG. 2.
Figure 4B:
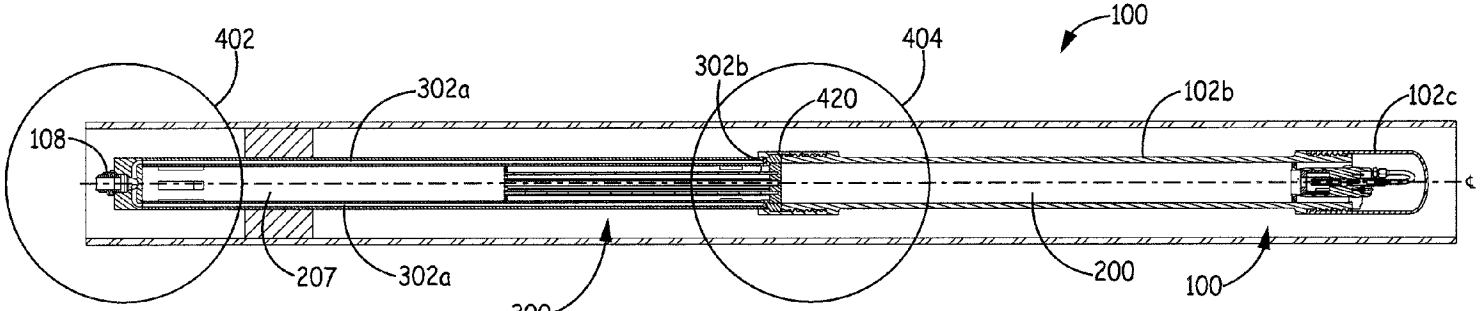
FIG. 4B is a cross-sectional side view of the thermal gas lift along section line 4B-4B of FIG. 3.
Figure 4C:
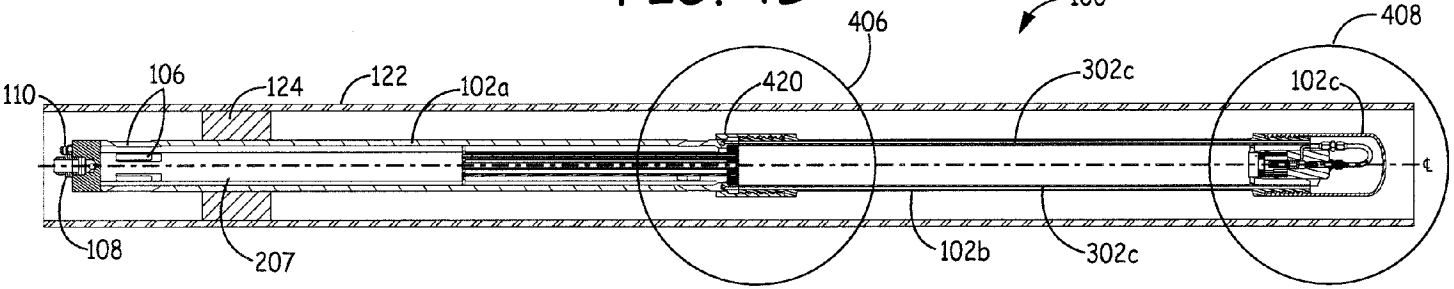
FIG. 4C is a cross-sectional side view of the thermal gas lift along section line 4C-4C of FIG. 3.
Figure 6A:
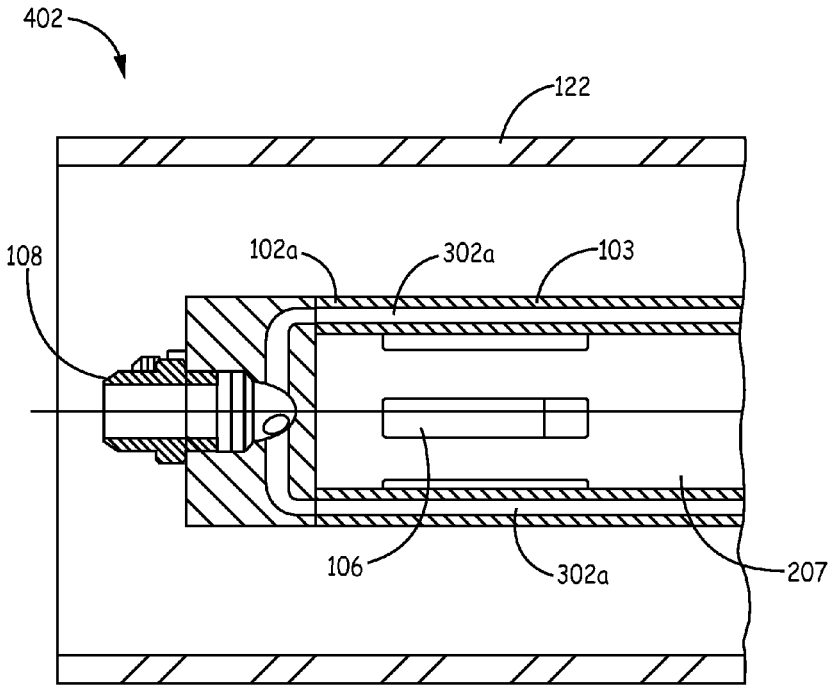
FIG. 6A is a partial close-up cross-sectional view of the thermal gas lift of FIG. 4B.

FIG. 2 illustrates a side view of the thermal gas lift 100 and the packing seal 124. The housing 102 includes a first housing portion 102*a* that includes the oil inlet ports 104 and the oil and gas outlet ports 106, a second housing portion 102*b* and a third housing portion 102*c*. FIG. 3 illustrates a top view of the thermal gas lift 100 within the casing 122. The top view of FIG. 3 illustrates the first delivery intake connector 108 and the second delivery intake connector 110. Referring to cross-sectional side views in FIGS. 4A-4C, the components of an embodiment of the thermal gas lift 100 are provided. In particular, FIG. 4A is a cross-sectional view of the thermal gas lift 100 along section line 4A-4A of FIG. 2, FIG. 4B is a cross-sectional view of the thermal gas lift 100 along section line 4B-4B of FIG. 3 and FIG. 4C is a cross-sectional view of the thermal gas lift 100 along section line 4C-4C of FIG. 3. The thermal gas lift 100 of this embodiment, includes a combustor system 101 that includes a combustor 500 that is received in the third housing portion 102*c* and a combustion chamber 200 that is formed within the second housing portion 102*b*. The thermal gas lift 100 further includes a thermal exchange system 300 and a mix chamber 207 (oil and exhaust gas mixing chamber). The combustor 500 of the combustor system 101 ignites gases pumped into the thermal gas lift 100 via the first and second delivery intake connectors 108 and 110. In particular, passages in the housing 102 deliver the gases to the combustor 500. For example, referring to close-up section view 402 of the thermal gas lift 100 illustrated in FIG. 6A, an illustration of the first delivery intake connector 108 is shown. As illustrated, the first housing portion 102*a* includes passages 302*a* that are aligned with a passage in the first delivery intake connector 108 in which a gas flows through. Passages 302*a* are within an outer shell 103 of the housing 102 and extend through the length of the first housing portion 102*a*, as illustrated in FIG. 4B. Referring to the close-up section view 404 illustrated in FIG. 6B, passages 302*a* extend to passages 302*b* that extends radially around a second end of the first housing portion 102*a*. The close-up section view 406 of FIG. 6C further illustrates the connection of passages 302*b* to passages 302*c* in the second housing portion 102*b*. Passages 302*b* extend in the second housing portion 102*b* to the combustor 500 as illustrated in the close-up section view 408 illustrated in FIG. 6D. Hence, one method of providing passages for fluids, such as fuel and air to the combustor 500 has been provided. Passages 302*a*, 302*b*, and 302*c* not only provide a delivery means, the passages 302*a*, 302*b*, and 302*c* also provide a way of cooling the jacket (housing 102). That is, the flow of relatively cool air and fuel passing through the passages 302*a*, 302*b*, and 302*c*, helps cool the housing portions 102*a* and 102*b* when the combustor 500 is operating.

Figure 6B:
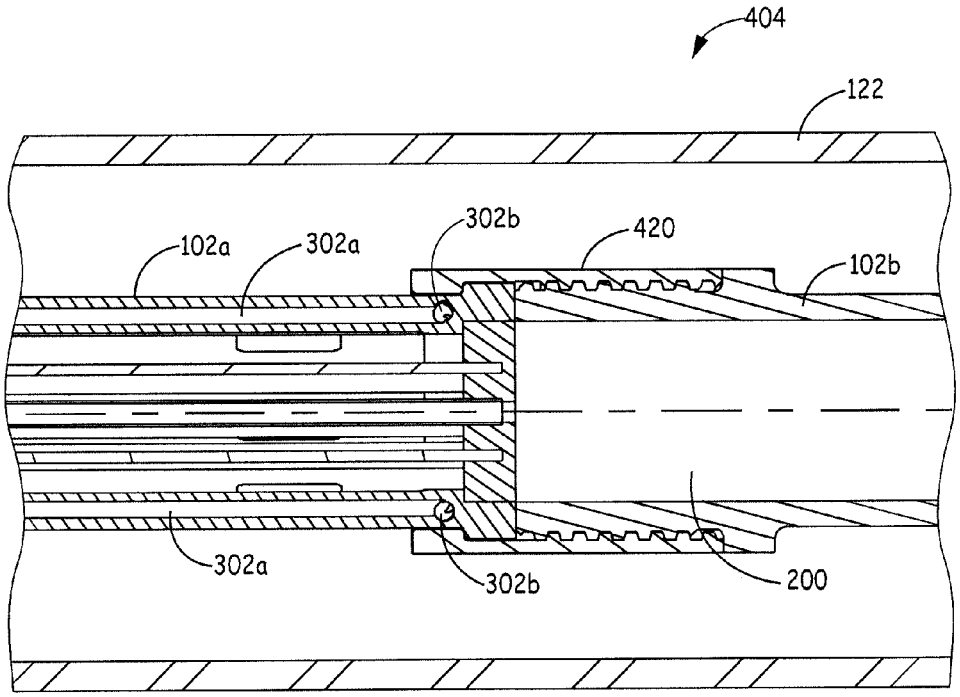
FIG. 6B is another partial close-up cross-sectional view of the thermal gas lift of FIG. 4B.
Figure 6C:
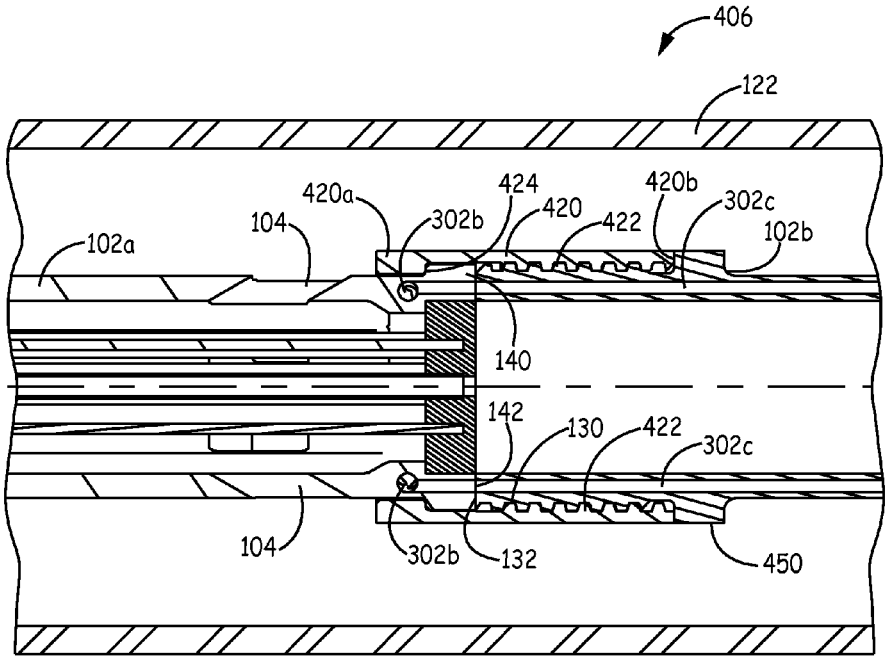
FIG. 6C is a partial close-up cross-sectional view of the thermal gas lift of FIG. 4C.

Close-up section views 404 and 406 of FIGS. 6B and 6C show a connection sleeve 420 used to couple the first housing portion 102*a* to the second housing portion 102*b*. As illustrated in FIG. 6C, the connection sleeve 420 includes internal threads 422 that threadably engage external threads 130 on the second housing portion 102*b*. The external threads 130 of the second housing portion 102*b* are proximate a first end 132 of the second housing portion 102*b*. The connection sleeve 420 further includes an internal retaining shelf portion 424 proximate a first end 420*a* of the sleeve 420 that is configured to abut a lip 140 that extends from a surface of the first housing portion 102*a* to couple first housing portion 102*a* to the second housing portion 102*b*. The lip 140 extends from the first housing portion 102*a* proximate a second end 142 of the first housing portion 102*a*. External threads 130 that extend from the first end 132 of the second housing portion 102*b* terminate at a first connection ring 450 that extends around an outer surface of the second housing portion 102*b*. The first connection ring 450 of the second housing portion 102*b* abuts a second end 420*b* of the connection sleeve 420 when the connection sleeve 420 is coupling the first housing portion 102*a* to the second housing portion 102*b*. In one embodiment, a seal (not shown) is positioned between connections between the connection sleeve 420 and the first and second housing portions 102*a* and 102*b* to seal the combustion chamber 200.

Figure 6D:
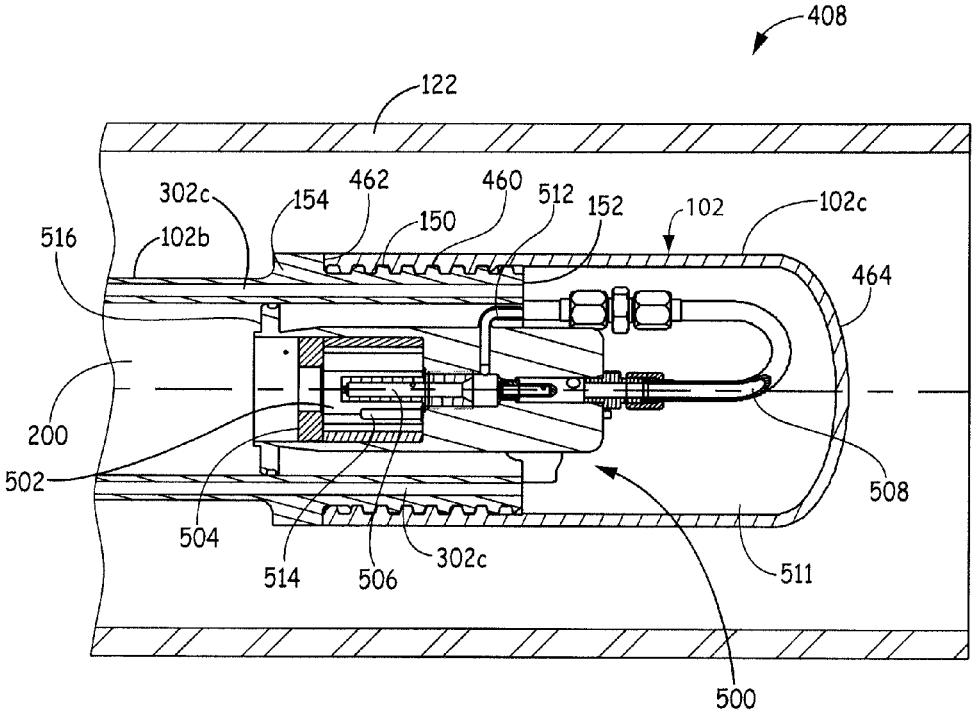
FIG. 6D is another partial close-up cross-sectional view of the thermal gas lift of FIG. 4C.

Close-up section view 408 of FIG. 6D, illustrates a connection between the second housing portion 102*b* and the third housing portion 102*c*. The third housing portion 102*c* can also be referred to as the "combustor cover" 102*c*. The combustor cover 102*c* includes internal threads 460 that extend from an open end 462 of the combustor cover 102*c* a select distance. The combustor cover 102*c* further includes a closed end 464. The internal threads 460 of the combustor cover 102*c* are engaged with external threads 150 on the second housing portion 102*b*. The external threads 150 extend from a second end 152 of the second housing portion 102*b* to a second ring 154 that extends around an outer surface of the second housing portion 102*b*. As illustrated, an edge about the open end 462 of the combustor cover 102*c* engages the second ring 154 when the combustor cover 102*c* is threadably engaged with the second housing portion 102*b*. In one embodiment, a seal (not shown) is positioned between the combustor cover 102*c* and the second housing portion 102*b* to seal the combustor 500 from external elements.

Close-up section view 408 of FIG. 6D further illustrates the combustor 500 of an embodiment. A similar combustor is described in U.S. Provisional Patent Application No. 61/664,015, titled "Apparatuses and Methods Implementing a Downhole Combustor," filed on Jun. 25, 2012, which is herein incorporated in its entirety by reference. The combustor 500 includes a fuel delivery conduit 508 that is coupled to a delivery passage, such as a delivery passage 302*c*, in the second housing portion 102*b* of the housing 102. The fuel delivery conduit 508 is coupled to deliver fuel to a pre-mix fuel injector 506. Also coupled to the pre-mix fuel injector 506 is an air delivery conduit 512. The air delivery conduit 512 receives air through one of the delivery passages, such as delivery passage 302*c*, illustrated in the second housing portion 102*b* of the housing 102. In one embodiment, the air is delivered from the delivery passages 302*c* into an inner chamber 511 formed in the third housing portion 102*c* of the housing 102. The air and the fuel are mixed in the pre-mix fuel injector 506 and are delivered into an ignition cavity 502. The ignition cavity 502 is designed to ensure consistent and reliable ignition of the air/fuel mixture, as described further in U.S. Provisional Patent Application No. 61/664,015, even in a relatively high pressure environment. That is, combustion can be achieved with the present design of the thermal gas lift 100 even though the pressure in the combustion area of the thermal gas lift 100 can reach 2,000 psi or more, while the thermal gas lift 100 itself is subject to pressures of 30,000 psi or more in deep oil reserves. One or more glow plugs 514 are used to initiate combustion in the ignition cavity 502. The combustor 500 further includes a fuel injector plate 504 that includes a plurality of fuel injector ports, which are in fluid communication with a fuel delivery passage in the second housing portion 102*b* of the housing 102. Also illustrated in FIG. 6D is an air injection plate 516. The air injection plate 516 includes a plurality of passages that pass air into the combustion chamber 200 of the housing 102. In particular, the plurality of passages in the air injection plate 516 is in fluid communication with the air delivery passages in the second housing portion 102*b* of the housing 102. Air from the air injection plate 516, (which in one embodiment is an air swirl plate 516) and fuel from the fuel injector plate 504 are mixed and burned in the combustion chamber 200 of housing 102. The fuel and the air in combustion chamber 200 are initially ignited by the ignited air-fuel mixture from the ignition cavity 502. Once the fuel and the air in the combustion chamber 200 are ignited, the power to the glow plugs 514 is shut off. As described above, in one embodiment one of the delivery intake connectors 108 or 110 provides a connection to a conductive path through the housing 102 to supply the power to the one or more glow plugs 514.

Figure 5A:
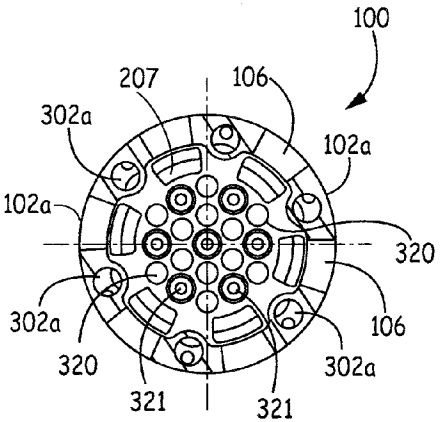
FIG. 5A is a cross-sectional top view of the thermal gas lift along section line 5A-5A of FIG. 2.
Figure 5B:
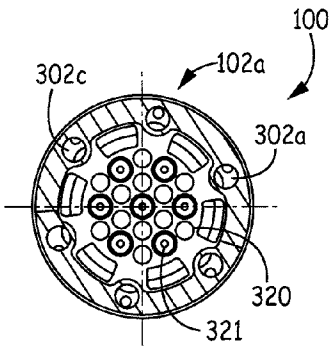
FIG. 5B is a cross-sectional top view of the thermal gas lift along section line 5B-5B of FIG. 2.

The chemical energy of the gas in the combustion chamber 200 is converted into thermal energy due to the combustion of the air-fuel mixture, and temperature rises in the combustion chamber 200. The heat from the hot gases is used by the thermal exchange system 300 (FIG. 4A) in the first housing portion 102*a* to heat up oil 206 from the oil reservoir 205 entering in the oil intake ports 104 of the housing 102 (FIG. 1). The thermal exchange system 300 includes heat exchange tubes 320. The incoming oil 206 from the oil input ports 104 flows around the heat exchange tubes 320 therein receiving heat from the heat exchange tubes 320. Some of the tubes 320 have exhaust passages 321 (or combustion chamber exhaust ports 321) that allow the hot gases to escape from the combustion chamber 200 into the oil 206 passing through the first housing portion 102*a* and out the oil and gas outlet ports 106. The heat exchange tubes 320 can be further seen in the cross-sectional top view of FIG. 5A. In particular, FIG. 5A illustrates a top cross-sectional view of the thermal gas lift 100 along section line 5A-5A of FIG. 2. As illustrated in this view, top views of the heat exchange tubes 320 in the oil and exhaust gas mixing chamber 207 of the first section 102*a* of the housing 102 are shown. Some of the heat exchange tubes 320 include exhaust passages 321 (or exhaust ports) that allow the exhaust gas from the combustion chamber 200 to travel into the oil and exhaust gas mixing chamber 207. Also illustrated in FIG. 5A, is the oil and gas outlet ports 106 through the first housing portion 102*a* and passages 302*a* that deliver the fuel and air to the combustor 500. As discussed above, one of the passages 302*a* can be used as a path for a conductor to provide power to the one or more glow plugs 514 for initial ignition of the combustor 500. FIG. 5B illustrates a cross-sectional top view along section line 5B-5B of FIG. 2. This view is below the oil and gas outlet ports 106 in the first housing section 102*a*, but still above the heat exchange tubes 320.

Figure 5C:
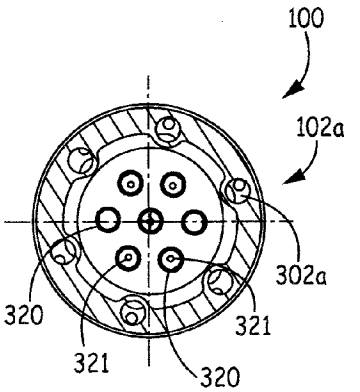
FIG. 5C is a cross-sectional top view of the thermal gas lift along section line 5C-5C of FIG. 2.
Figure 5D:
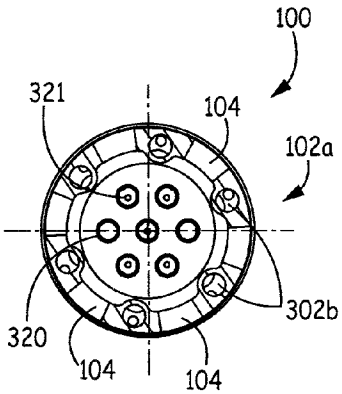
FIG. 5D is a cross-sectional top view of the thermal gas lift along section line 5D-5D of FIG. 2.

FIG. 5C illustrates a cross-sectional top view along section line 5C-5C of FIG. 2. FIG. 5C illustrates mid-portions of some of the heat exchange tubes 320. FIG. 5D illustrates a cross-sectional top view along section line 5D-5D of FIG. 2.

Figure 5E:
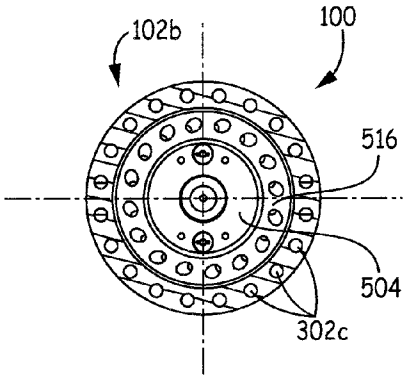
FIG. 5E is a cross-sectional top view of the thermal gas lift along section line 5E-5E of FIG. 2.

FIG. 5D illustrates the oil intake ports 104 through the first housing section 102*a*. Finally, FIG. 5E illustrates a cross-sectional top view along section line 5E-5E of FIG. 2. FIG. 5E illustrates a top of the fuel injector plate 504, the air swirl plate 516 and a plurality of passages 302*c* through the second housing portion 102*b*. As discussed above, the passages 302*c* provide paths for the fuel and the air to the combustor 500, as well as a conductor path to provide power to the glow plugs 514 of the combustor 500.

Figure 7:
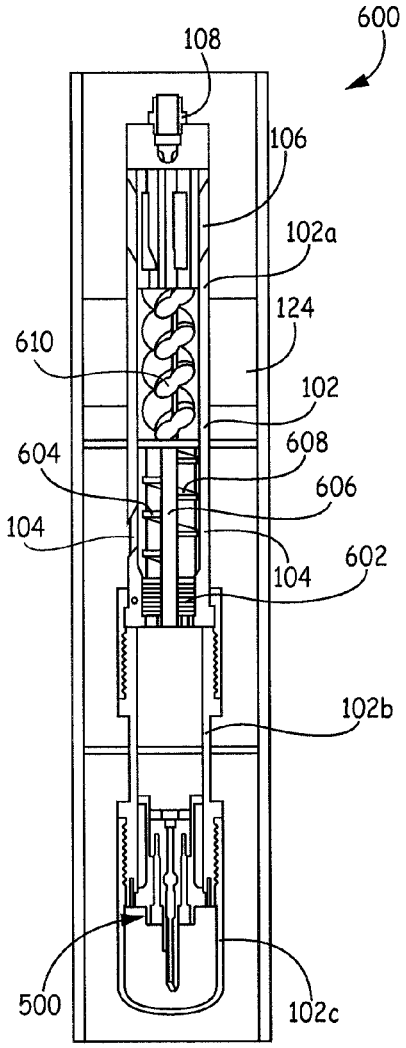
FIG. 7 is a cross-sectional side view of a power generator including a downhole combustor of one embodiment of the present application.
Figure 8:
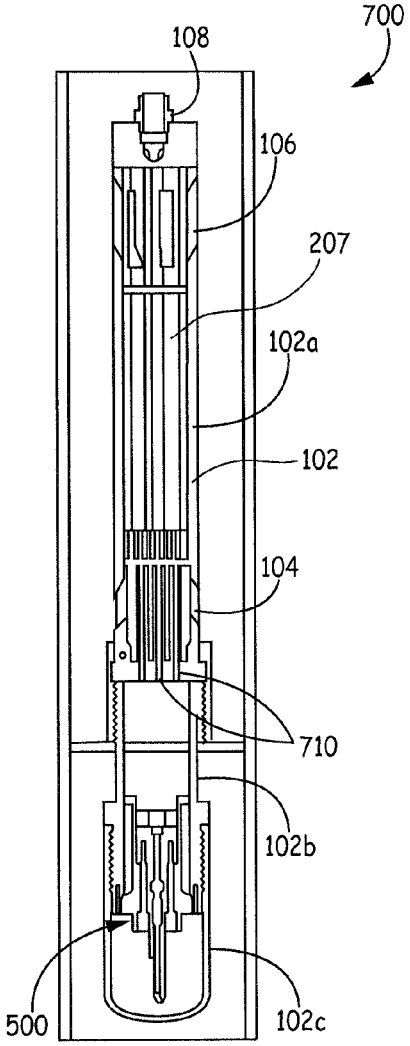
FIG. 8 is a cross-sectional side view of a reforming system including a downhole combustor of one embodiment of the present application.

As discussed above, the downhole combustor 500 may have many different applications. For example, referring to FIG. 7, a power generator 600 is illustrated. In this embodiment, the combustor 500 transitions into an axial flow turbo-expander 602. The combustor 500 heats the oil and the combination of the heated oil and exhaust gases turns a progressive cavity pump 604 of power generator 600 having a rotationally mounted rod 606 with offset helically swept fins 608 and 610. The rotation of the progressive cavity pump 604 is used to generate direct mechanical work. The mechanical work, in one embodiment, can be used to generate electricity. This embodiment is useful when the wellbore is really deep and losses from power supplied externally at those distances are great. Hence, a power generating source down the wellbore is beneficial in this situation. Another embodiment that uses a downhole combustor 500 is illustrated in FIG. 8. FIG. 8 illustrates a reforming system 700. A reforming system 700, similar to the thermal lift system described above, is used to improve oil mobility with a mixture of heat plus the hydrogenation of the oil with a catalyst to generate byproducts such as $H_2$, $H_2O$, CO and $CO_2$. In an embodiment of the reforming system 700, the downhole combustor 500 will support reaction temperatures of approximately 200° C. to 800° C., depending on different reaction temperatures and reaction times. An exhaust gas of $CO_2$ will act as a solvent, lowering the heavy oil viscosity and density. For higher hydrogen to carbon ratio fuels, (such as methane) a steam reformer section is added to alter the chemical composition to a lighter mobile oil for ease of transportation. Lower hydrogen to carbon ratio fuels (such as propane) can react with water in the heavy oil to add additional $H_2$ for the reaction process. The reforming system 700 of FIG. 8 includes a high pressure combustor 500 that combusts gases delivered through the housing 102, as discussed above. Exhaust gases are passed through the reformer heat exchange system 710 which heats the oil that enters the oil inlet ports 104 in the housing 102. The exhaust gases are then injected into the oil in the oil and exhaust gas mixture chamber 207 and the reformed hydrocarbon is passed out the oil and gas outlet ports 106 of the housing 102. Hence, the downhole combustor system described above has many different applications.

Although specific embodiments have been illustrated and described herein, it will be appreciated by those of ordinary skill in the art that any arrangement, which is calculated to achieve the same purpose, may be substituted for the specific embodiments shown. This application is intended to cover any adaptations or variations of the present invention. Therefore, it is manifestly intended that this invention be limited only by the claims and the equivalents thereof.

The invention claimed is:

1. A downhole combustor system comprising:

a longitudinally extending housing configured and arranged to be positioned down a wellbore of a production well, the housing including:

a first housing portion having an oil and gas mixing chamber, the first housing portion having at least one inlet ort to the oil and as mixing chamber to allow passage of oil from an oil reservoir in communication with the wellbore into the oil and gas mixing chamber, the first housing portion further having at least one outlet port out of the oil and gas mixing chamber to allow passage of mixed oil from the oil reservoir and exhaust gas out of the oil and gas mixing chamber into the wellbore, the at least one outlet port spaced a longitudinal distance above the at least one inlet port; and a second housing portion comprising a combustion chamber below the first housing portion, the second housing portion coupled to the first housing portion;

a combustor below the combustion chamber configured and arranged to combust fuel in the combustion chamber;

a plurality of heat exchange tubes received within the first portion of the housing proximate the oil and gas mixing chamber and laterally adjacent to the at least one inlet port, the heat exchange tubes coupled to transfer heat of exhaust gases generated in the combustion chamber and passing through the plurality of heat exchange tubes to oil entering the first portion of the housing through the at least one inlet port;

at least one exhaust port positioned to deliver exhaust gases from at least some of the plurality of heat exchange tubes into the oil and gas mixing chamber; and a packing seal disposed about the housing between the at least one inlet port and the at least one outlet port for providing a seal between the housing and a casing lining the wellbore.

2. The downhole combustor system of claim 1, wherein:

the housing has a plurality of delivery passages; and further comprising at least one input delivery connector in fluid communication with at least one of the delivery passages to deliver at least one of air and fuel to the combustor.

3. The downhole combustor system of claim 2, wherein the plurality of delivery passages in the housing is configured and arranged to cool the housing.

4. The downhole combustor system of claim 1, further comprising:

a third housing portion coupled to the second housing portion and housing the combustor.

5. The downhole combustor system of claim 4, further comprising:

a sleeve configured and arranged to couple the second housing portion to the first housing portion.

6. The downhole combustor system of claim 1, wherein the plurality of heat exchange tubes form at least a part of a heat exchange system received in the housing proximate the combustion chamber, the heat exchange system configured and arranged to transfer heat from the combustion chamber to oil within the first portion of the housing.

7. The downhole combustor system of claim 1, further comprising:

at least one of a thermal gas lift system, an energy generating system and an oil reforming system.

8. A downhole combustor system for a production well, the downhole combustor system comprising:

a housing configured for disposition in a wellbore and comprising an oil and exhaust gas mixing chamber and a combustion chamber, the housing having at least one oil input port passing through an outer shell of the housing allowing passage into the housing of oil from an oil reservoir in communication with the wellbore, the housing further having at least one oil and exhaust gas output port passing through the outer shell of the housing at a longitudinally spaced distance from the at least one oil input port, the at least one oil and exhaust gas output port configured and arranged to pass oil and exhaust gas out of the housing, the housing further having at least one delivery passage within the outer shell of the housing;

a packing seal disposed about the housing between the at least one oil input port and the at least one oil and exhaust gas output port for providing a seal between the housing and a casing lining the wellbore;

at least one delivery connector coupled to the housing, the at least one delivery connector in fluid communication with at least one associated delivery passage;

a combustor configured and arranged to combust fuel in a combustion chamber, the combustor configured and arranged to receive fuel and air passed through the at least one delivery passage;

a plurality of heat exchange tubes received within the housing proximate the oil and exhaust mixing chamber, each heat exchange tube coupled to receive exhaust gases generated in the combustion chamber, to transfer heat from the exhaust gases to oil in the housing; and exhaust ports positioned to pass exhaust gases from at least some heat exchange tubes of the plurality to the oil and exhaust gas mixing chamber.

9. The downhole combustor system of claim 8, wherein the housing further comprises:

a first housing portion, the first housing portion having a first end and an opposed, second end, the first housing portion forming the oil and exhaust gas mixture chamber;

a second housing portion, a first end of the second housing portion coupled to the second end of the first housing portion, the second housing portion comprising the combustion chamber; and a third housing portion coupled to a second end of the second housing portion and containing the combustor.

10. The downhole combustor system of claim 8, wherein the plurality of heat exchange tubes form at least part of a heat exchange system received in the housing proximate the combustion chamber, the heat exchange system configured and arranged to transfer heat generated in the combustion chamber to oil in the oil and exhaust gas mixing chamber.

11. The downhole combustor system of claim 8, further comprising:

at least one of a thermal gas lift system, an energy generating system and a reforming system.

12. A method of extracting oil from an oil reservoir, the method comprising:

positioning a downhole combustor in a wellbore in communication with the oil reservoir;

sealing the wellbore between a casing structure lining the wellbore and an exterior of a housing containing an oil and gas mixing chamber, a combustor and a combustion chamber of the combustor system with a packing seal;

delivering fuel to the combustor through passages in the housing;

initiating an ignition system of the combustor to combust the fuel in the combustion chamber;

heating oil passing into the housing from the oil reservoir below the packing seal with a plurality of heat exchange tubes positioned below the oil and gas mixing chamber that are in communication with exhaust gases from the combustion chamber;

mixing the oil passed into the housing with exhaust gases exiting at least some of the plurality of heat exchange tubes into the oil and gas mixing chamber; and venting exhaust gases mixed with oil from the housing into the wellbore above the packing seal.

13. The method of claim 12, further comprising:

cooling the housing with fuel delivered through passages in the housing.

14. The method of claim 12, further comprising:

reforming oil, at least in part in the combustor with the exhaust gases from the combustion chamber.

15. The method of claim 12, further comprising:

generating mechanical work using energy from the exhaust gases from the combustion chamber.

* * * * *

UNITED STATES PATENT AND TRADEMARK OFFICE

CERTIFICATE OF CORRECTION

PATENT NO. : 9,228,738 B2
APPLICATION NO. : 13/745196
DATED : January 5, 2016
INVENTOR(S) : Daniel Tilmont et al.

It is certified that error appears in the above-identified patent and that said Letters Patent is hereby corrected as shown below:

In the claims:

| | | | |
|---|---|---|---|
| CLAIM 1, | COLUMN 7, | LINE 66, | change "inlet ort to the oil" to --inlet port to the oil-- |
| CLAIM 1, | COLUMN 7, | LINE 66, | change "as mixing chamber" to --gas mixing chamber-- |

Signed and Sealed this
Twelfth Day of April, 2016

Michelle K. Lee

Michelle K. Lee
*Director of the United States Patent and Trademark Office*